US008669402B2

(12) United States Patent
Bessonette et al.

(10) Patent No.: US 8,669,402 B2
(45) Date of Patent: Mar. 11, 2014

(54) FUEL COMPOSITIONS

(75) Inventors: Paul W. Bessonette, Deptford, NJ (US); Charles H. Schleyer, Lincoln University, PA (US); Kevin P. Duffy, Deeping Gate (GB)

(73) Assignees: ExxonMobil Research and Engineering Company, Annandale, NJ (US); Caterpillar Inc., Peoria, IL (US)

( * ) Notice: Subject to any disclaimer, the term of this patent is extended or adjusted under 35 U.S.C. 154(b) by 258 days.

(21) Appl. No.: 13/380,557

(22) PCT Filed: Jun. 17, 2010

(86) PCT No.: PCT/US2010/001747

§ 371 (c)(1), (2), (4) Date: Dec. 23, 2011

(87) PCT Pub. No.: WO2011/014226

PCT Pub. Date: Feb. 3, 2011

(65) Prior Publication Data

US 2012/0102824 A1 May 3, 2012

Related U.S. Application Data

(60) Provisional application No. 61/271,864, filed on Jul. 27, 2009.

(51) Int. Cl.
*C10L 1/18* (2006.01)

(52) U.S. Cl.
USPC ..... 585/14; 44/388; 44/451

(58) Field of Classification Search
USPC ..... 44/388, 451; 585/14
See application file for complete search history.

(56) References Cited

U.S. PATENT DOCUMENTS

| | | | | |
|---|---|---|---|---|
| 4,479,807 | A * | 10/1984 | Rebandt | 44/451 |
| 6,139,775 | A | 10/2000 | Thames | |
| 7,540,888 | B2 | 6/2009 | Ryder et al. | |
| 2007/0246005 | A1 | 10/2007 | Sobotowski et al. | |
| 2008/0190354 | A1 | 8/2008 | Malpas et al. | |

* cited by examiner

*Primary Examiner* — Cephia D Toomer
(74) *Attorney, Agent, or Firm* — Watov & Kipnes, P.C.; Kenneth Watov

(57) ABSTRACT

A fuel composition for a homogenous charge compression ignition engine includes a combination of a gasoline fuel and a diesel fuel, the combination having a derived cetane number of from about 19.9 to 45 as determined in accordance with ASTM method D6890. A method for making the fuel composition provides for blending presently available gasoline fuel and diesel fuel together in a ratio to obtain the desired fuel composition.

24 Claims, 4 Drawing Sheets

| PROPERTY | TEST METHOD | CONVENTIONAL DIESEL (ULSD) | GASOLINE/DIESEL BLENDS | | | | CONVENTIONAL GASOLINE (SUPREME) |
|---|---|---|---|---|---|---|---|
| | | | GD35 | GD30 | GD25 | GD20 | |
| | | | | | | | |
| DENSITY, kg/L | ASTM D4052 | 0.8388 | 0.8086 | 0.7966 | 0.7844 | 0.7712 | 0.7581 |
| DERIVED CETANE NUMBER | ASTM D6890 | 45.0 | 34.5 | 29.5 | 24.8 | 19.9 | 14.5 |
| KINEMATIC VISCOSITY @ 40°C, $mm^2/s$ | ASTM D445 | 2.02 | 1.04 | 1.04 | 0.82 | 0.64 | ------ |
| BOILING RANGE ($T_{10}$–$T_{90}$), °C | ASTM D86 | 213–308 | 76 –295 | 66 –261 | 64 –252 | 62 –225 | 62 –151 |
| SULFUR, mg/kg | ASTM D2622 | 11 | 16 | 17 | 19 | 20 | 22 |
| VAPOR PRESSURE, psi @ 37.8°C | ASTM D5191 | ------ | 3.80 | 4.77 | 5.41 | 6.11 | 6.77 |
| HFRR LUBRICITY, MICRONS | ASTM D6079 | ------ | 210 | 245 | 287 | 350 | ------ |

FIG. 2

FUEL COMPOSITIONS

PRIORITY CLAIM

This Application takes priority from PCT/US2010/001747, having an international filing date of 17 Jun. 2010, which takes priority from U.S. Provisional Application Ser. No. 61/271,864, filed on 27 Jul. 2009.

FIELD OF THE INVENTION

The present invention is generally related to fuels for internal combustion engines, and is more particularly related to a fuel composition for homogenous charge compression ignition (HCCI) engines.

BACKGROUND OF THE INVENTION

Homogenous charge compression ignition (HCCI) is a mode of combustion offering the potential for significant improvements in efficiency and substantial reduction in emissions. HCCI further offers the potential for meeting or exceeding the more restrictive emissions regulations expected in the near future. HCCI engines typically initiate combustion using a thoroughly pre-mixed fuel/air mixture, which may be mixed in the intake port or the cylinder. Within the cylinder, the density and temperature of the fuel/air mixture is increased through compression until ignition occurs. As the ignition occurs at several locations at a time, the fuel/air mixture burns nearly simultaneously, which greatly reduces NOx and PM emissions compared to traditional combustion engines such as the diesel engine. The HCCI engines also realize other benefits including enhanced fuel economy due to their higher compression ratios and the absence of throttling.

It should be understood that the term "HCCI" as used herein is intended to include any engine condition for which completely homogeneous fuel-air mixing does not necessarily occur, yet significant fuel-air mixing still takes place, e.g., so-called pre-mixed charge compression ignition (PCCI).

Unfortunately, HCCI engines are difficult to control due to the extremely rapid combustion and absence of a triggering ignition event. At higher temperatures, there is a tendency for the pre-mixed air/fuel mixture to combust rapidly. If the combustion is especially rapid, high rates of pressure rise can cause excessive noise and potential engine damage. The traditional measures available in gasoline and diesel engines for triggering ignitions are not particularly useful for controlling ignition timing and combustion in an HCCI engine.

Other challenges facing HCCI engines include lack of universal, yet practical, measures of ignition quality of HCCI fuels, and excessive particulate/smoke emissions during operation on diesel boiling range fuels, especially at high engine loads. In addition, HCCI engines operate at high air/fuel ratios and/or high exhaust gas recirculation (EGR) rates for the purpose of controlling combustion phasing, peak cylinder pressure, rate of cylinder pressure rise and/or NOx emissions. This restricts the amount of fuel that can be burned in the course of an engine cycle and thus limits the maximum achievable engine loads. For example, HCCI engines operated on a typical 45 cetane number US diesel fuel can typically produce, at most, only ⅓ of the load attainable by comparable diesel engines, if the comparison is made at the same diesel-like compression ratio.

Studies have shown that the fuels formulated for combustion in an engine under HCCI conditions require an ignition quality that is significantly different from gasoline and diesel fuels currently on the market. Producing, distributing and marketing a completely separate fuel exclusively for HCCI applications presents a significant economic investment and burden on fuel companies.

Accordingly, there is a need for a fuel composition, and a method for producing the same particularly suited for combustion under HCCI conditions. There is a need for a fuel composition and method for producing the same, capable of at least meeting the ignition quality requirements of optimum HCCI fuel. There is a further need for a fuel composition and method for producing the same that utilizes existing infrastructure for storing and supplying a fuel optimized for HCCI applications.

SUMMARY OF THE INVENTION

The present invention relates generally to a fuel composition and methods for making the same. The fuel composition of the present invention is formulated for engines that operate under homogenous charge compression ignition (HCCI) conditions. The method for making the fuel composition is designed to provide a fuel composition that meets or exceeds the ignition quality specifications associated with HCCI engines. The fuel composition of the present invention enhances useful power of the HCCI engine, while minimizing emissions of partially combusted fuel and soot, and emissions of nitrogen oxides ($NO_x$). In particular, the present fuel composition includes a blend of gasoline fuel and diesel fuel suitable for combustion in an engine under HCCI conditions. The fuel composition can be prepared from separate tanks of gasoline fuel and diesel fuel, which provides the flexibility of varying the ratio amounts of the two fuels and thus the ignition quality of the resulting blend in the fuel composition to optimize performance.

The present invention further enables the fuel composition of the present invention to be formulated using existing commercially available fuels which greatly reduces the burden on current fuel manufacturing and delivery infrastructures. As a result, the fuel composition of the present invention can be readily formulated and distributed to the consumer in an efficient and cost effective manner. Moreover, the present invention allows fuel suppliers to avoid having to make extensive modifications to infrastructure required to store and segregate a new fuel specifically for HCCI applications. The fuel composition can be produced by blending gasoline and diesel at the refinery, at the fuel distribution terminal, at the service station or within the vehicle using existing commercially available fuels, thereby providing maximum flexibility for industries involved in fuel production and distribution, and engine manufacturing.

In one aspect of the present invention, there is provided a fuel composition comprising a combination of a gasoline fuel and a diesel fuel, the combination having a derived cetane number of from about 19.9 to 45 as determined in accordance with ASTM D-6890.

In another aspect of the present invention, there is provided a method for making a fuel composition, comprising the step of blending a gasoline fuel and a diesel fuel to yield a derived cetane number of from about 19.9 to 45 as determined in accordance with ASTM D-6890.

BRIEF DESCRIPTION OF THE DRAWINGS

Various embodiments of the invention are described in greater detail below with reference to the drawings, in which like terms are identified by the same reference designation, wherein:

FIG. 2 is a table showing the properties of fuel compositions formulated for HCCI engines from conventional gasoline and diesel fuels in accordance with the present invention;

DETAILED DESCRIPTION OF THE INVENTION

Figure 1:
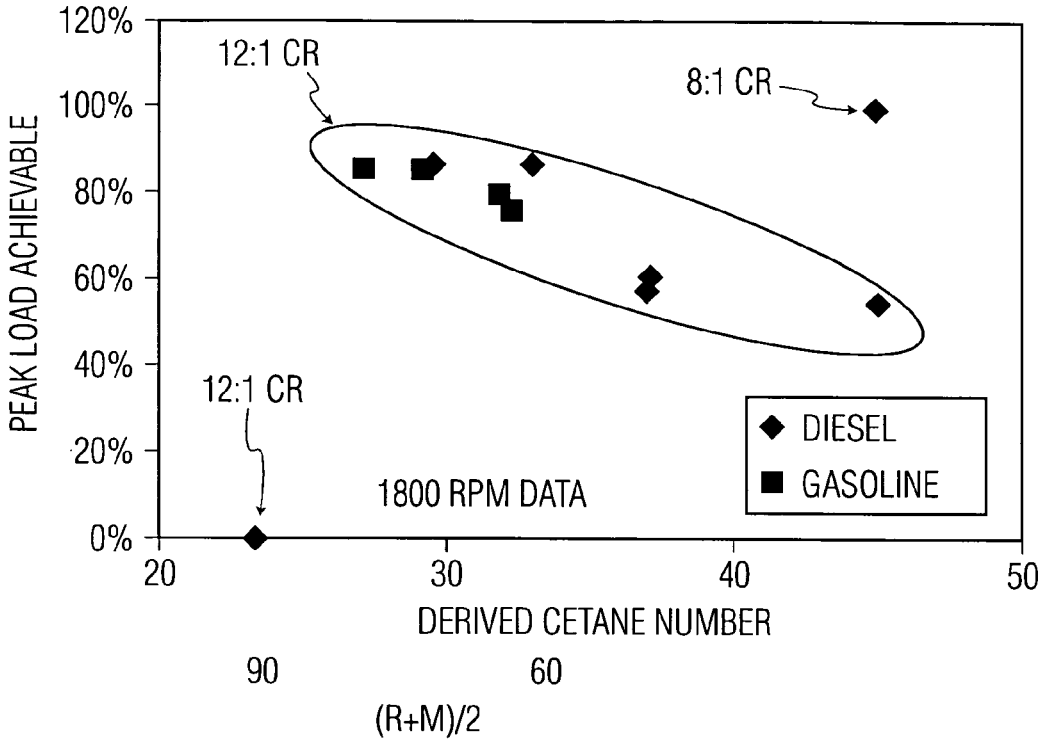
FIG. 1 is a graph showing the effect of octane number, and derived cetane number as determined in accordance with ASTM D-6890, for gasoline and diesel, respectively, on peak load achievable under the corresponding compression ratios.

The present invention is directed generally to a fuel composition and methods for making the same. The fuel composition of the present invention is formulated for engines that operate under homogenous charge compression ignition (HCCI) conditions. The method for making the fuel composition is designed to provide a fuel composition that meets or exceeds the ignition quality requirements associated with HCCI engines. The fuel composition of the present invention enhances useful power of the HCCI engine, while minimizing emissions of partially combusted fuel and soot, and emissions of nitrogen oxides ($NO_x$). In particular, the present fuel composition includes a blend of gasoline fuel and diesel fuel suitable for combustion in an engine under HCCI conditions. The fuel composition can be prepared from separate tanks of gasoline fuel and diesel fuel, which provides the flexibility of varying the ratio amounts of the two fuels and thus the ignition quality of the resulting blend in the fuel composition to optimize performance.

The present invention enables the fuel composition of the present invention to be formulated using existing commercially available fuels, which greatly reduces the burden on current fuel manufacturing and delivery infrastructures. As a result, the fuel composition of the present invention can be readily formulated and distributed to the consumer in an efficient and cost effective manner. Moreover, the present invention allows fuel suppliers to avoid having to make extensive modifications to infrastructure required to store and segregate a new fuel specifically for HCCI applications. The fuel composition can be produced by blending gasoline and diesel at the refinery, at the fuel distribution terminal, at the service station or within the vehicle using existing commercially available fuels, thereby providing maximum flexibility for industries involved in fuel production and distribution and engine manufacturers.

One issue when blending gasoline and diesel is the flammability of the fuel air mixture in the headspace above the fuel. Typically the headspace above a gasoline fuel is too rich to be flammable while the headspace above a diesel fuel is too lean. Mixtures of gasoline and diesel can produce a flammable headspace mixture. The volatility of the diesel and gasoline fuels, the blend ratio and ambient temperature pose the largest impact on headspace flammability.

A flammable mixture can be avoided by: 1) maintaining the gasoline and diesel as separate fluids until injected into the engine, 2) by ensuring that the gasoline fuel is high enough in vapor pressure such that the resulting mixture with diesel is too rich to be flammable or 3) to include a high volatility stream such as butane, pentanes or light straight run as an additive to the gasoline and diesel fuels such that the headspace mixture is too rich to be flammable.

The term "diesel fuel" is defined as a mixture of hydrocarbons which boil at atmospheric pressure over a temperature range within about 150° C. to 380° C., preferably from about 160° C. to 350° C., and the term "gasoline fuel" is defined as a mixture of hydrocarbons which boil at atmospheric pressure over a temperature range within about 25° C. to 220° C., preferably from about 62° C. to 151° C.

The term "derived cetane number" is a universal measure of autoignitability for fuels formulated for use in HCCI engines, and is determined in accordance with the method described in American Society for Testing and Materials (ASTM) D-6890 or similar measurements of ignition quality, wherein the derived cetane number is based on a combination of hydrocarbons, oxygenates, and/or other major fuel components.

The term "octane number" is a measurement of ignition quality of a fuel during spark ignition as determined in accordance with the antiknock index defined in ASTM D-4814 or similar measurement of ignition quality, wherein the octane number is based on a combination of hydrocarbons, oxygenates, and/or other major fuel components.

The term "cetane number" is a measurement of ignition quality of a fuel during compression ignition as determined in accordance with the standard specification defined in ASTM D-613 or similar measurement of ignition quality, wherein the cetane number is based on a combination of hydrocarbons, oxygenates, and/or other major fuel components.

The operating range of HCCI engines relies predominantly on the ignition quality of the fuels, with little or no effect by the fuel components or volatility. Applicants have noted that the optimum fuel for HCCI operation has an ignition quality between the ignition quality of gasoline fuels and diesel fuels currently available in the market, where the optimum HCCI diesel fuel has a lower cetane number than commercially available diesel fuel, and the optimum HCCI gasoline fuel has a lower octane number than commercially available gasoline fuel. By varying the ratio of gasoline fuel and diesel fuel, an optimum fuel ignition quality and volatility can be formulated to yield a fuel composition having a particular derived cetane number corresponding to each engine operation condition (e.g., engine startup, and high load operation). This is especially useful for variable compression ratio engines and engines equipped with variable valve timing.

In one embodiment of the present invention, there is provided a fuel composition comprising a combination of a gasoline fuel and a diesel fuel, the combination having a derived cetane number of from about 19.9 to 45 as determined in accordance with ASTM D-6890. Preferably, the derived cetane number is from about 25 to 35, and more preferably from about 24.8 to 34.5.

The fuel composition of the present invention can further comprise a density as measured by ASTM D-4052, or similar measurement of density, of from about 0.70 kg/L to 0.85 kg/L, and preferably from about 0.76 kg/L to 0.83 kg/L.

The fuel composition of the present invention can further comprise a kinematic viscosity at 40° C. as measured by ASTM D-445, or similar measurement of kinematic viscosity, of from about 0.50 $mm^2/s$ to 4.1 $mm^2/s$, and preferably from about 0.7 to 2.0 $mm^2/s$.

The fuel composition of the present invention can further comprise a boiling temperature range ($T_{10}$-$T_{90}$) as measured by ASTM D-86, or similar measurement of boiling temperature range, of from about 45° C. to 340° C., and preferably from about 66° C. to 320° C.

The fuel composition of the present invention can further comprise a vapor pressure as measured by ASTM D-5191, or similar measurement of vapor pressure, of from about 3.80 to 15.0 psi at 37.8° C.

The fuel composition of the present invention can further comprise a High Frequency Reciprocating Rig (HFRR) lubricity as measured by ASTM D-6079, or similar measurement of HFRR lubricity, of from about 210 microns to 730 microns, and preferably from about 210 microns to 350 microns.

The fuel composition of the present invention can further comprise a sulfur content as measured by ASTM D-2622, or similar measurement of sulfur content, of from about 2 mg/kg to 30 mg/kg, and preferably from about 4 mg/kg to 20 mg/kg.

The fuel composition of the present invention can further comprise an ethanol content of from about 1% to 85%.

The fuel composition of the present invention can further comprise a biodiesel content of from about 1% to 50%.

In accordance with the present invention, the gasoline fuel used to formulate the present fuel composition has an octane number or antiknock index of less than 100, preferably from about 60 to 100, and more preferably from about 85 to 95.

In accordance with the present invention, the diesel fuel used to formulate the present fuel composition has a cetane number of less than 55, preferably from about 25 to 55, and more preferably 37 to 55;

With reference to FIG. 1, the graph shows the maximum engine load that is achievable under HCCI conditions in a single cylinder test engine as a function of the ignition quality of the fuel for an engine speed of 1800 rpm. Most of the results shown were obtained utilizing a compression ratio of 12:1, while a single result was obtained at a compression ratio of 8:1. Higher efficiencies are realized at the higher compression ratio. The results in FIG. 1, show that the highest peak engine loads at a representative compression ratio were achieved when the ignition quality of the fuel was from about 25 to 35 derived cetane number for diesel fuels and from about 60 to 80 (RON+MON)/2 octane number, or antiknock index, for gasoline fuels.

Applicants have noted that currently available US diesel fuel has a minimum cetane number of 40, and currently available US gasoline fuel has a minimum octane number or antiknock index ((RON+MON)/2) of 87. As the results of FIG. 1 indicate, the optimum fuel for HCCI operation possesses an ignition quality between currently available gasoline and diesel fuels. The fuel composition of the present invention exhibits such ignition quality optimized for HCCI engines.

As noted, currently available diesel fuel is lower in octane number than currently available gasoline fuel. Correspondingly, currently available gasoline fuel is lower in cetane number than currently available diesel fuel. A blend of currently available gasoline fuel and diesel fuel yields a fuel composition, having both a lower octane number and a lower cetane number as compared to the individual gasoline fuel and diesel fuel, respectively, which is especially suitable for HCCI engines. The ignition quality of the blended fuels can be varied as needed to meet the requirements of the HCCI engine under different conditions through varying the ratio amounts of the gasoline fuel and the diesel fuel as will be described hereinafter.

With reference to FIG. 2, four fuel compositions of the present invention designated GD20, GD25, GD30, and GD35 were produced from conventional gasoline and diesel fuel for engine testing. The properties of the fuel compositions GD20, GD25, GD30 and GD35, respectively, are shown, along with the corresponding properties of the conventional gasoline and diesel fuels used to prepare the fuel compositions. The results in FIG. 2 show that the ignition quality of the fuel compositions is located between the ignition qualities of conventional gasoline and diesel fuel, respectively, as measured by the derived cetane number.

A wide range of fuels can be produced depending on the properties of the diesel and gasoline fuels and the blend ratio. In FIG. 2, the conventional gasoline used was a summer gasoline with relatively low vapor pressure. A winter gasoline with higher vapor pressure, up to 15 psi, can also be used to increase the vapor pressure in the blends of gasoline and diesel and to widen the fuel boiling range somewhat. The sulfur content of the blended fuel will be intermediate between the gasoline and diesel fuel. Lower sulfur is advantageous to improve the performance of any aftertreatment device. Similarly viscosity, density and boiling range can vary over wider ranges than shown in FIG. 2, depending on the corresponding properties of the gasoline and diesel fuel used to prepare the blend. In addition either or both the gasoline and the diesel fuel can contain oxygenates or hydrocarbons made from biofuels. The most widely used biofuels are ethanol in gasoline and biodiesel in diesel fuel.

Two of the fuel compositions, GD25 and GD35, were separately tested in a single-cylinder direct-injection test engine under HCCI conditions. Successful HCCI engine operation was achieved using these test fuels at several engine load points, with very low NOx and particulate matter (PM) emissions.

The tests were conducted on a single-cylinder test engine derived from the Caterpillar 3406 engine. Fuel was directly injected in the cylinder with a common-rail fuel injector that utilized a multi-hole, narrow-angle HCCI injector nozzle. A piston was chosen, such that the geometric compression ratio was 14:1. The engine was also equipped with a variable intake valve actuation system (IVA) that allowed the intake valve closing to be varied.

The intake and exhaust manifold pressures were set by controlling the boost and backpressure control valves respectively. The intake manifold pressure was set at each operating mode to be consistent with a typical multi-cylinder production C15 engine. The exhaust backpressure was then set based on the intake manifold pressure and assumed turbocharger efficiency.

The gaseous emissions (NOx, CO, HC, CO2) were measured at the exit of the exhaust surge tank using a Horiba MEXA emissions analyzer. The smoke emissions were also measured at the exit of the exhaust surge tank using an AVL 415 Smoke Meter.

Three fuels, GD25, GD35 and a 45 cetane diesel fuel, were tested separately at 1200 rpm at 400, 600 and 700 kPa BMEP. Emissions and fuel consumption were measured at each operating point for a range of fuel injection timings, fuel injection pressures, EGR (Exhaust Gas Recirculation) rates and intake valve closing timings. Three general conclusions were drawn from the comparison of diesel fuel, GD25 and GD35:

1) The blending of gasoline and diesel fuel is a plausible technique to change the ignition properties of the fuel. The combustion phasing responded somewhat linearly to the change in derived cetane number.

2) The amount of EGR needed to achieve HCCI combustion with the desired combustion phasing was reduced with gasoline/diesel fuel blends. While lower EGR rates can result in lower fuel consumption and increase load capability for HCCI combustion, EGR is also necessary to NOx emissions control. Depending on the desired NOx emissions level, a certain level of EGR may be required that is greater than necessary to control combustion phasing.

3) The gasoline/diesel blends showed significant smoke reduction relative to diesel fuel.

Figure 3:
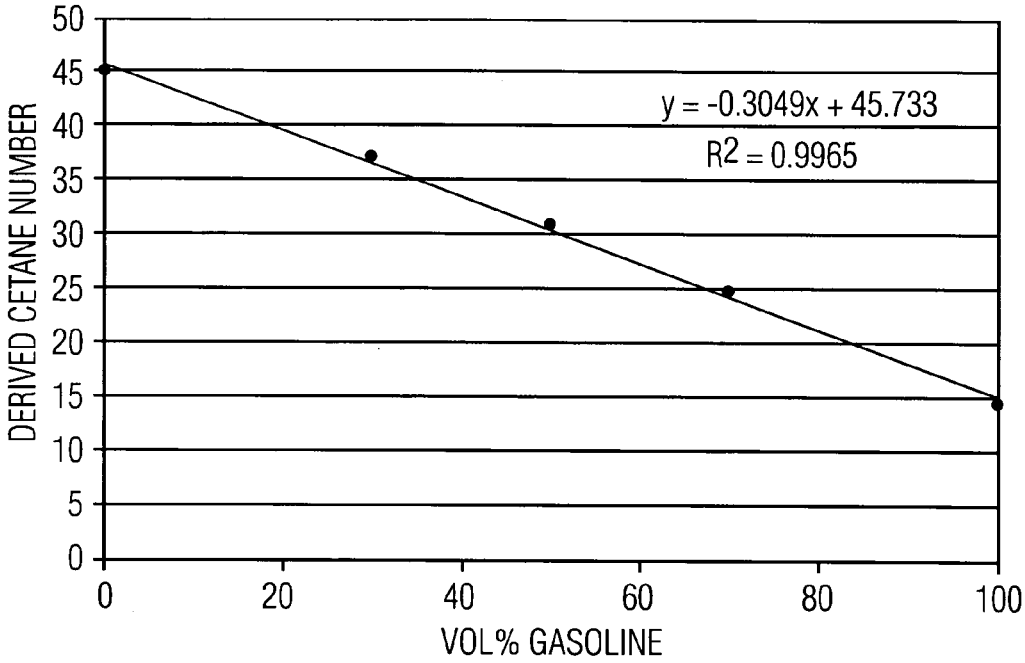
FIG. 3 is a response curve showing the derived cetane number of a blend of gasoline and diesel versus the percent volume of gasoline content in the blend for one embodiment of the present invention.

In another embodiment of the present invention, there is provided a method for making a fuel composition, comprising the step of blending a gasoline fuel and a diesel fuel to yield a derived cetane number of from about 19.9 to 45 as determined in accordance with ASTM D-6890. To prepare a blend of gasoline and diesel fuel having a particular desired target ignition quality as measured by derived cetane number, the ignition qualities of several test blends prepared containing varying ratios of gasoline and diesel fuel are measured. These results are used to derive an ignition quality of the blend versus percent by volume gasoline in the blend response curve from which the necessary blend ratio to provide the desired blend ignition quality as measured by derived cetane number can be readily interpolated. It was found that such a response curve is linear to a first approximation. An example of the response curve is shown in FIG. 3.

The fuel composition of this invention meets the lower octane and cetane requirements of the optimum HCCI fuel. Furthermore, by using the present method, fuel suppliers avoid the need for extensive additional infrastructure required to store and segregate a new fuel for HCCI applications only. In addition, through the use of the present method, the present fuel composition can be blended at terminals or service stations from already existing stores of commercially available gasoline fuel and diesel fuel.

Figure 4:
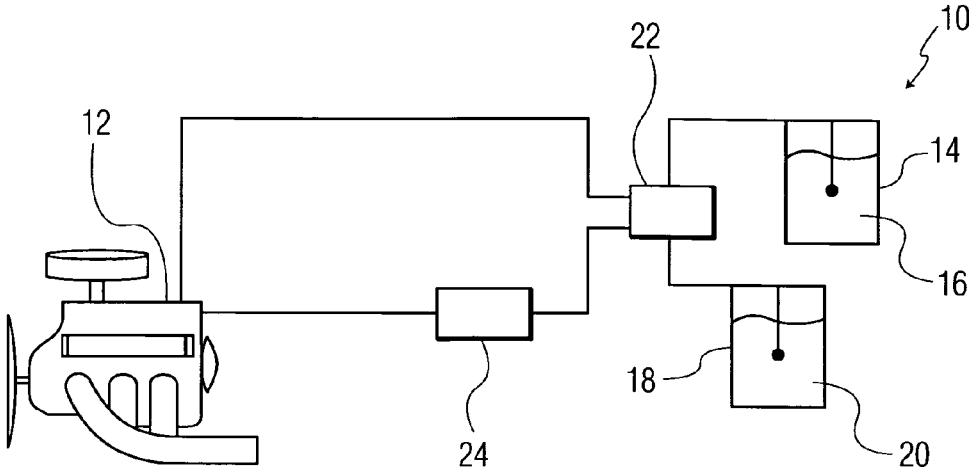
FIG. 4 is a schematic block diagram of a fuel system having a first fuel tank for storing a gasoline fuel and a second fuel tank for storing a diesel fuel, adapted for supplying a fuel composition to a homogenous charge compression engine in accordance with the present invention.

Additionally, other methods can be used for producing or implementing the optimum fuel for HCCI engines as described above. With reference to FIG. 4, a motorized vehicle 10 operating using an HCCI engine 12 can be designed with a first fuel tank 14 containing a commercially available gasoline fuel 16, and a second fuel tank 18 containing a commercially available diesel fuel 20, where each fuel 16 and 20, respectively, meets its current, respective specifications. The vehicle 10 further includes a fuel pump/mixer 22, and a controller 24 for regulating the fuel pump/mixer 22 and sensing the load conditions of the engine 12. The controller 24 is programmed to formulate the fuel composition having an intermediate ignition quality to achieve optimum HCCI performance. It will be understood to those skilled in the art that the controller 24 can be employed using an application specific integrated circuit (ASIC), for example, to perform various computations, functions and the like.

The controller 24 directs the fuel pump/mixer 22 to draw from the tanks 14 and 18 specific amounts of the gasoline and diesel fuels 16 and 20, respectively, where they are mixed on-board the vehicle 10 prior to injection into the engine using a single fuel injector. The ratio of gasoline to diesel fuels 16 and 20, respectively, in the mixture can be fixed. Preferably, the controller 24 can be programmed to have the capability to vary the amount of gasoline and diesel fuels 16 and 20, respectively, in the injected mixture depending on engine 12 and ambient conditions as determined by the controller 24. Previous work has shown that the optimum ignition quality of a fuel to achieve high load in HCCI applications will depend on the engine compression ratio, thus, the optimum ratio of gasoline to diesel fuel in the injected mixture depends on the compression ratio of the engine.

Alternatively, the commercial gasoline and diesel fuels 16 and 20, contained in the first and second tanks 14 and 18, respectively, on the vehicle 10 can be injected into the engine 12 separately using two separate injection systems. For example, the gasoline fuel 16 can be introduced using a port fuel injected (PFI) system, while the diesel fuel 20 can be introduced into the combustion chamber by direct injection (DI). The controller 24 ensures that the injected relative amounts of gasoline and diesel fuels 16 and 20, respectively, correspond to a gasoline/diesel mixture in the combustion chamber having the necessary ignition quality to provide optimum HCCI performance. The controller 24 allows for the variation in the relative amounts of injected gasoline and diesel fuels 16 and 20, respectively, to be able to adapt the ignition quality of the gasoline/diesel fuel mixture to flexibly optimize performance depending on engine and ambient conditions. The injection system can be designed to separately inject the gasoline and diesel fuel 16 and 20, respectively, at the same time, or with different injection timings for each.

Producing the optimum HCCI fuel from separate fuel tanks 14 and 18 on-board the vehicle 10 containing gasoline and diesel fuel 16 and 20, respectively, offers the advantage to flexibly optimize the ratio of gasoline and diesel fuel (and thus, the ignition quality) in the injected fuel mixture in response to changing engine and ambient conditions. For example, while optimum high load HCCI performance can be achieved using a fuel with ignition quality between the ignition qualities of conventional gasoline and diesel, a higher cetane number fuel is suitable during initial cold-starting operation of the engine. Furthermore, the flexibility to vary the ignition quality of the gasoline/diesel fuel mixture for different engine cycles is advantageous to instantaneously match optimum fuel ignition quality with changing compression ratio in a variable compression ratio engine. This also applies in instantaneously matching optimum fuel ignition quality with changing effective compression ratio in an engine equipped with intake valve actuation or other form of variable valve timing.

Figure 5:
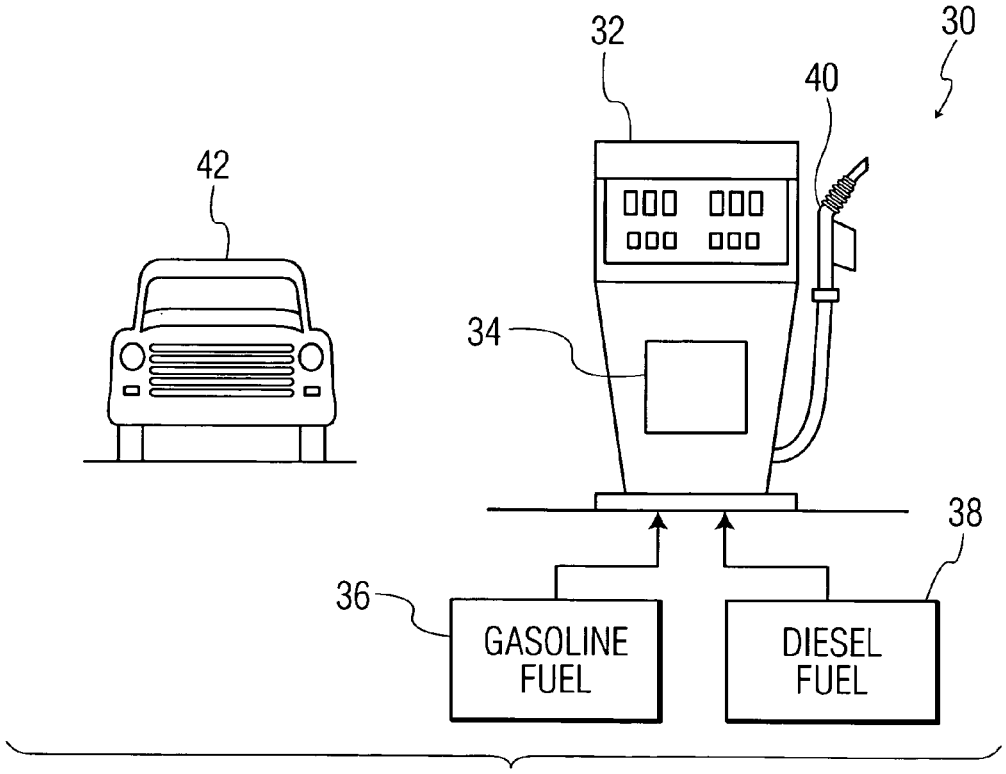
FIG. 5 is a schematic diagram of a fueling station having a first fuel tank for storing a gasoline fuel and a second fuel tank for storing a diesel fuel, adapted for supplying a fuel composition to a vehicle with a homogenous charge compression engine in accordance with the present invention.

With reference to FIG. 5, a liquid fuel blending delivery area 30 is shown. In this example, a blending pump 32 includes octane and cetane sensor assembly 34, and one or more underground storage tanks 36 and 38 for separately storing a gasoline fuel and a diesel fuel, for example. The first and second tanks 36 and 38, respectively, are directly connected to the blending pump 32. The first tank 36 contains a gasoline fuel having an octane number of less than 100 and the second tank 38 contains a diesel fuel having a cetane number of less than 55. Additional tanks can be used to receive and store gasoline and diesel fuels at various octane and cetane numbers, respectively.

The gasoline and diesel fuels stored in tanks 36 and 38, respectively, are drawn by the blending pump 32 to deliver the fuel composition of the present invention from its nozzle 40 into an HCCI equipped vehicle 42. In this manner, the blending pump 32 can be operated to dispense gasoline fuel for gasoline engine vehicles, diesel fuel for diesel engine vehicles, and blended gasoline/diesel fuel for HCCI engine vehicles having a desired derived cetane number for the HCCI engine of the vehicle being fueled.

Alternatively, in the event that HCCI engine fuel requirements become standardized, blending of standard gasoline and diesel fuels can be performed at the refinery for delivery to service stations. The preblended HCCI fuel can then be dispensed having a standardized derived cetane number, utilizing dispensing stations providing three different standardized HCCI fuels, similar to the present gasoline dispensed premium, intermediate or plus, and regular octane gasoline. An alternative embodiment of this concept would be dispensing one or more standardized HCCI fuels at a service station in addition to standard gasoline and diesel fuels.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A fuel composition comprising a combination of a gasoline fuel and a diesel fuel, said combination having a derived cetane number of from about 19.9 to 45 as determined in accordance with ASTM D-6890.

2. The fuel composition of claim 1, wherein the derived cetane number is from about 24.8 to 34.5.

3. The fuel composition of claim 1, wherein the gasoline fuel comprises an antiknock index number of less than 100.

4. The fuel composition of claim 1, wherein the antiknock index number of the gasoline fuel is from about 60 to 100.

5. The fuel composition of claim 4, wherein the antiknock index number of the gasoline fuel is from about 85 to 95.

6. The fuel composition of claim 1, wherein the diesel fuel comprises a cetane number of less than 55.

7. The fuel composition of claim 1, wherein the cetane number of the diesel fuel is from about 25 to 55.

8. The fuel composition of claim 7, wherein the cetane number of the diesel fuel is from about 37 to 55.

9. The fuel composition of claim 1, further comprising a density of from about 0.70 kg/L to 0.85 kg/L.

10. The fuel composition of claim 9, wherein the density is from about 0.76 kg/L to 0.83 kg/L.

11. The fuel composition of claim 1, further comprising a kinematic viscosity at 40° C. from about 0.50 to 4.1 $mm^2/s$.

12. The fuel composition of claim 11, wherein the kinematic viscosity at 40° C. is from about 0.7 to 2.0 $mm^2/s$.

13. The fuel composition of claim 1, further comprising a boiling range of from about 45° C. to 340° C.

14. The fuel composition of claim 13, wherein the boiling range is from about 66° C. to 320° C.

15. The fuel composition of claim 1, further comprising a vapor pressure of from about 3.80 psi to 15.0 psi at 37.8° C.

16. The fuel composition of claim 1, further comprising an HFRR lubricity of from about 210 microns to 730 microns.

17. The fuel composition of claim 1, further comprising a sulfur content of from about 2 mg/kg to 30 mg/kg.

18. A method for making a fuel composition, comprising the step of blending a gasoline fuel and a diesel fuel to yield a derived cetane number of from about 19.9 to 45 as determined in accordance with ASTM D-6890.

19. The method of claim 18, wherein the gasoline fuel comprises an antiknock index number of less than 100.

20. The method of claim 18, wherein the diesel fuel comprises a cetane number of less than 55.

21. The fuel composition of claim 1, further comprising an ethanol content of from about 1% to 85%.

22. The fuel composition of claim 1, further comprising a biodiesel content of from about 1% to 50%.

23. The fuel composition of claim 1, further comprising a non-flammable headspace at ambient temperatures.

24. The fuel composition of claim 1, further comprising an additive to ensure a non-flammable headspace at ambient temperatures.

* * * * *